US007711489B1

(12) United States Patent
Chadwick et al.

(10) Patent No.: US 7,711,489 B1
(45) Date of Patent: May 4, 2010

(54) TRIDENT PROBE GROUNDWATER EXCHANGE SYSTEM

(75) Inventors: David Bartholomew Chadwick, San Diego, CA (US); Gregory Jon Groves, San Diego, CA (US); Christopher Field Smith, Medford, NY (US); Ronald J. Paulsen, Riverhead, NY (US)

(73) Assignee: United States of America as represented by Secretary of the Navy, Washington, DC (US)

( * ) Notice: Subject to any disclaimer, the term of this patent is extended or adjusted under 35 U.S.C. 154(b) by 345 days.

(21) Appl. No.: 11/862,392

(22) Filed: Sep. 27, 2007

(51) Int. Cl.
*G01N 15/08* (2006.01)

(52) U.S. Cl. ..... 702/12; 702/45; 702/32; 702/49; 73/861.23; 73/861; 73/204.22; 166/107

(58) Field of Classification Search ..... 702/22, 702/23, 12, 45, 32, 49; 73/861.23, 861, 232, 73/269, 38, 223, 224, 73, 204.22; 166/53, 166/64, 68, 264, 107
See application file for complete search history.

(56) References Cited

U.S. PATENT DOCUMENTS 4,391,137 A * 7/1983 Kerfoot et al. ..... 73/204.22
4,567,340 A * 1/1986 Latchum, Jr. ..... 219/701
5,299,141 A * 3/1994 Hungerford et al. ..... 702/49
5,339,694 A * 8/1994 Looney et al. ..... 73/861.07
5,432,709 A * 7/1995 Vollweiler et al. ..... 702/32
5,445,474 A * 8/1995 Lundegard et al. ..... 405/128.45
5,646,863 A * 7/1997 Morton ..... 702/23
6,874,371 B1 4/2005 Smith et al.
6,928,864 B1 * 8/2005 Henry et al. ..... 73/152.54
7,007,541 B2 * 3/2006 Henry et al. ..... 73/19.1
7,058,509 B2 * 6/2006 Sohl et al. ..... 702/2
2002/0046569 A1 * 4/2002 Faqih ..... 62/188
2005/0207939 A1 * 9/2005 Roussi et al. ..... 422/68.1
2008/0236257 A1 * 10/2008 de Jonge ..... 73/61.59
2009/0076632 A1 * 3/2009 Kram et al. ..... 700/33

OTHER PUBLICATIONS

D. B. Chadwick, J. G. Groves, L. He, C. F. Smith, R. J. Paulsen, B. Harre; New Techniques for Evaluating Water and Contaminant Exchange at the Groundwater-Surface Water Interface, IEEE 0-7803-7534-3, 2002.

SSC San Diego, Computer Sciences Corporation, Naval Facilities Engineering Services Center, Cornell Cooperative Extension of Suffolk County; Coastal Contaminant Migration Monitoring: the Trident Probe and UltraSeep System, Technical Report 1902, SSC San Diego, Jun. 2003.

D. Bart Chadwick, Adam Gordon, Jon Groves, Chris Smith, Ronald Paulsen, Bryan Harre; New Tools for Monitoring Coastal Contaminant Migration, Sea Technology Magazine, Jun. 2003.

(Continued)

*Primary Examiner*—Carol S Tsai
(74) *Attorney, Agent, or Firm*—Kyle Eppele; Allan Y. Lee; J. Eric Anderson

(57) ABSTRACT

A Trident Probe Groundwater Exchange System (NC#096456). The apparatus includes a groundwater conductivity sensor, designed to determine a groundwater conductivity surface; a water conductivity sensor, designed to determine a surface water conductivity groundwater; a temperature sensor, designed to determine a groundwater temperature; a surface water temperature sensor, designed to determine a surface water temperature; and a processor operatively coupled to a plurality of sensors and designed to receive information from the plurality of sensors.

17 Claims, 5 Drawing Sheets

OTHER PUBLICATIONS

D. Bart Chadwick; Coastal Contamination Migration Monitoring, RTDF Workshop, Power Point Presentation, posted to website [www.rtdf.org/PUBLIC/SEDIMENT/MINUTES/103002/chadwick.pdf] on Jun. 12, 2003.

* cited by examiner

300

TRIDENT PROBE GROUNDWATER EXCHANGE SYSTEM

FEDERALLY SPONSORED RESEARCH AND DEVELOPMENT

This invention (Navy Case No. 096456) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case Number 096456.

BACKGROUND OF THE INVENTION

The Trident Probe Groundwater Exchange System is generally in the field of groundwater evaluation.

Typical groundwater evaluation relies upon mathematical models based on lithology, which are inaccurate.

A need exists for groundwater evaluation tools and/or methods that do not rely upon inaccurate mathematical models.

BRIEF DESCRIPTION OF THE DRAWINGS

All FIGURES are not drawn to scale.

DETAILED DESCRIPTION OF THE INVENTION

Described herein is Trident Probe Groundwater Exchange System.

Definitions

The following acronym(s) are used herein:

Acronym(s):

GPS—Global Positioning System

GW—Groundwater

SW—Surface Water

TPGWES—Trident Probe Groundwater Exchange System

The trident probe groundwater exchange system includes a plurality of sensors and a processor. The system identifies areas of groundwater exchange by measuring and comparing characteristics (e.g., temperature and conductivity) of groundwater and surface water. In one embodiment, samples are taken after the system identifies areas of groundwater exchange.

Figure 1:
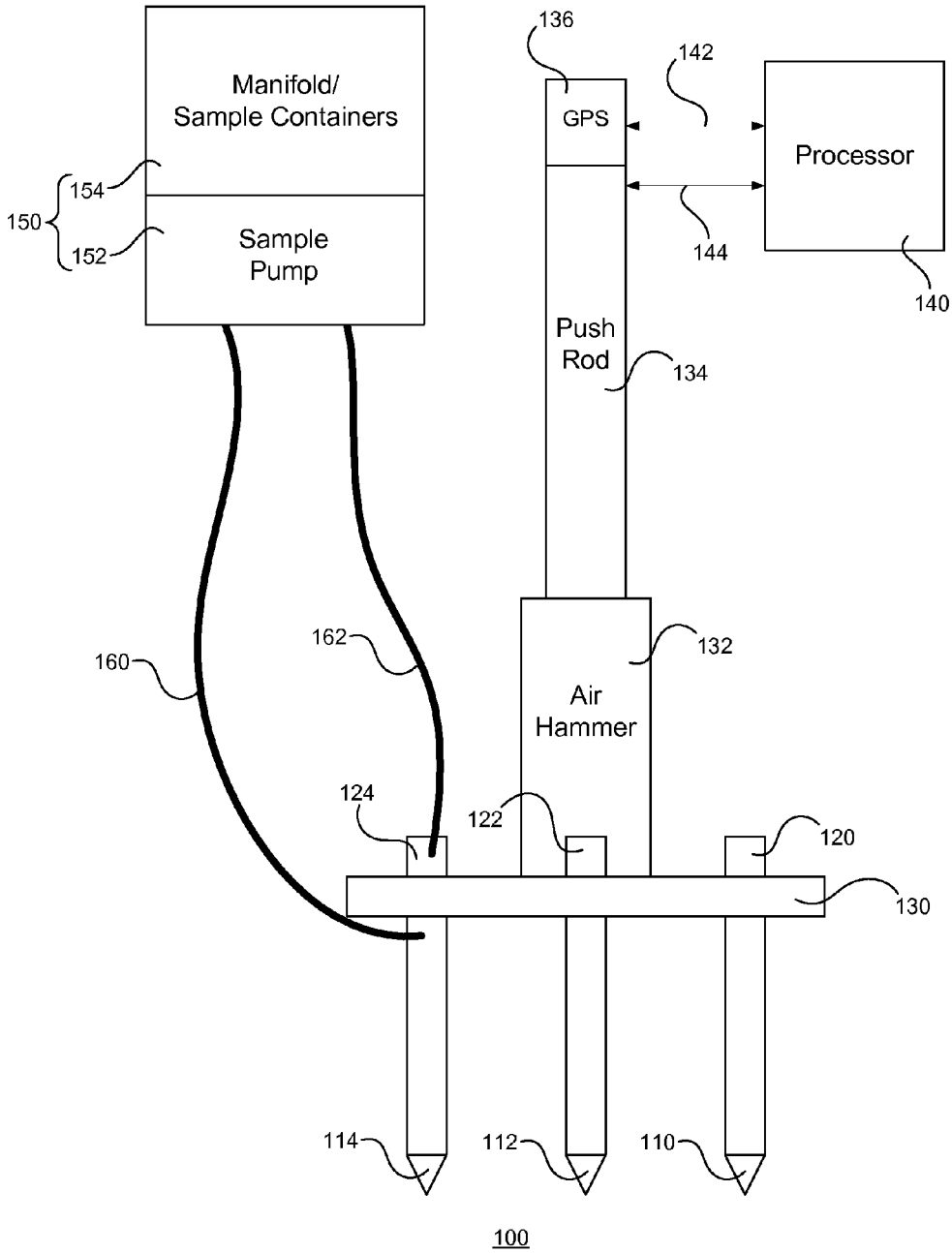
FIG. 1 is a block diagram of one embodiment of a Trident Probe Groundwater Exchange System.

FIG. 1 is a block diagram of one embodiment of a trident probe groundwater exchange system. As shown in FIG. 1, trident probe groundwater exchange system (TPGWES) 100 comprises groundwater (GW) conductivity sensor 110, GW temperature sensor 112, GW sampler 114, surface water (SW) conductivity sensor 120, SW temperature sensor 122, SW sampler 124, support member 130, air hammer 132, push rod 134, global positioning system (GPS) 136, processor 140, GPS data link 142, sensor data link 144, sampling mechanism 150, GW sample hose 160 and SW sample hose 162.

Support member 130 comprises a strong, rigid, corrosion-resistant material such as plastic, stainless steel, composite, wood and a combination of the like. Support member 130 is designed to provide mechanical support for the plurality of sensors and samplers of TPGWES 100. GW conductivity sensor 110, GW temperature sensor 112, GW sampler 114, SW conductivity sensor 120, SW temperature sensor 122 and SW sampler 124 are operatively coupled to support member 130.

GW conductivity sensor 110, GW temperature sensor 112 and GW sampler 114 are designed to be driven into a ground beneath surface water, while SW conductivity sensor 120, SW temperature sensor 122 and SW sampler 124 are designed to remain above the ground beneath surface water. GW conductivity sensor 110 is designed to obtain the conductivity of groundwater and output information regarding such. GW temperature sensor 112 is designed to obtain the temperature of groundwater and output information regarding such. GW sampler 114 is designed to obtain groundwater samples and output them to a sample container. SW conductivity sensor 120 is designed to obtain the conductivity of surface water and output information regarding such. SW temperature sensor 122 is designed to obtain the temperature of surface water and output information regarding such. GW sampler 124 is designed to obtain surface water samples and output them to a sample container.

Air hammer 132 is operatively coupled to support member 130. Air hammer 132 is designed to drive the plurality of GW sensors and sampler into a ground beneath surface water using well-known air hammer principles. Push rod 134 comprises a strong, rigid, corrosion-resistant material such as plastic, stainless steel, composite, wood and a combination of the like. Push rod 134 is operatively coupled to air hammer 132 and is designed to help manually drive groundwater sensors into a ground beneath surface water. In one operational embodiment, a person exerts force on push rod 134 to drive the plurality of GW sensors and sampler into a ground beneath surface water. In one embodiment, a person holds push rod 134 and air hammer 132 drives the plurality of GW sensors and sampler into a ground beneath surface water.

As shown in FIG. 1, GPS 136 is operatively coupled to push rod 134. Those skilled in the art shall recognize that GPS 136 can be operatively coupled to other components of TPGWES 100 without departing from the scope or spirit of the TPGWES 100 so long as GPS 136 remains above water during operation. GPS 136 is designed to provide accurate global positioning information to processor 140 using well-known satellite and GPS technology.

Sampling mechanism 150 is operatively coupled to GW and SW samplers 114, 124 via GW sampling hose 160 and SW sampling hose 162, respectively. Sampling mechanism 150 is designed to obtain groundwater and surface water samples. Sampling mechanism 150 comprises sample pump 152 and manifold/sample containers 154. Sample pump 152 is operatively coupled to GW sampling hose 160 and SW sampling hose 162. Sample pump 152 is operatively coupled to manifold/sample containers 154. Sample pump 152 is designed to draw groundwater from GW sampler 114 via GW sampling hose 160. In addition, sample pump 152 is designed to draw surface water from SW sampler 124 via SW sampling hose 162. Sample pump 152 inputs surface water and groundwater to manifold/sample containers 154 so that surface water is retained in separate sample containers from groundwater. Such samples can be used for additional water testing.

Processor 140 is designed to receive and compare sensor information from the plurality of sensors (e.g., GW conductivity sensor 110, GW temperature sensor 112, SW conductivity sensor 120 and SW temperature sensor 122). Processor 140 is operatively coupled to GPS 136 and the plurality of sensors (e.g., GW conductivity sensor 110, GW temperature sensor 112, SW conductivity sensor 120 and SW temperature sensor 122) via data links 142, 144. Specifically, GPS 136 is operatively coupled to processor 140 via GPS data link 142; and GW conductivity sensor 110, GW temperature sensor 112, SW conductivity sensor 120 and SW temperature sensor 122 are operatively coupled to processor 140 via sensor data link 144. Data links 142, 144 can be any well-known data link device such as fiber optic, copper wire, infrared, Bluetooth™ and radio frequency. In one embodiment, sensor data link 144 is located partially internal to push rod 134 and air hammer 132, which helps prevent damage to sensor data link 144.

Figure 2:
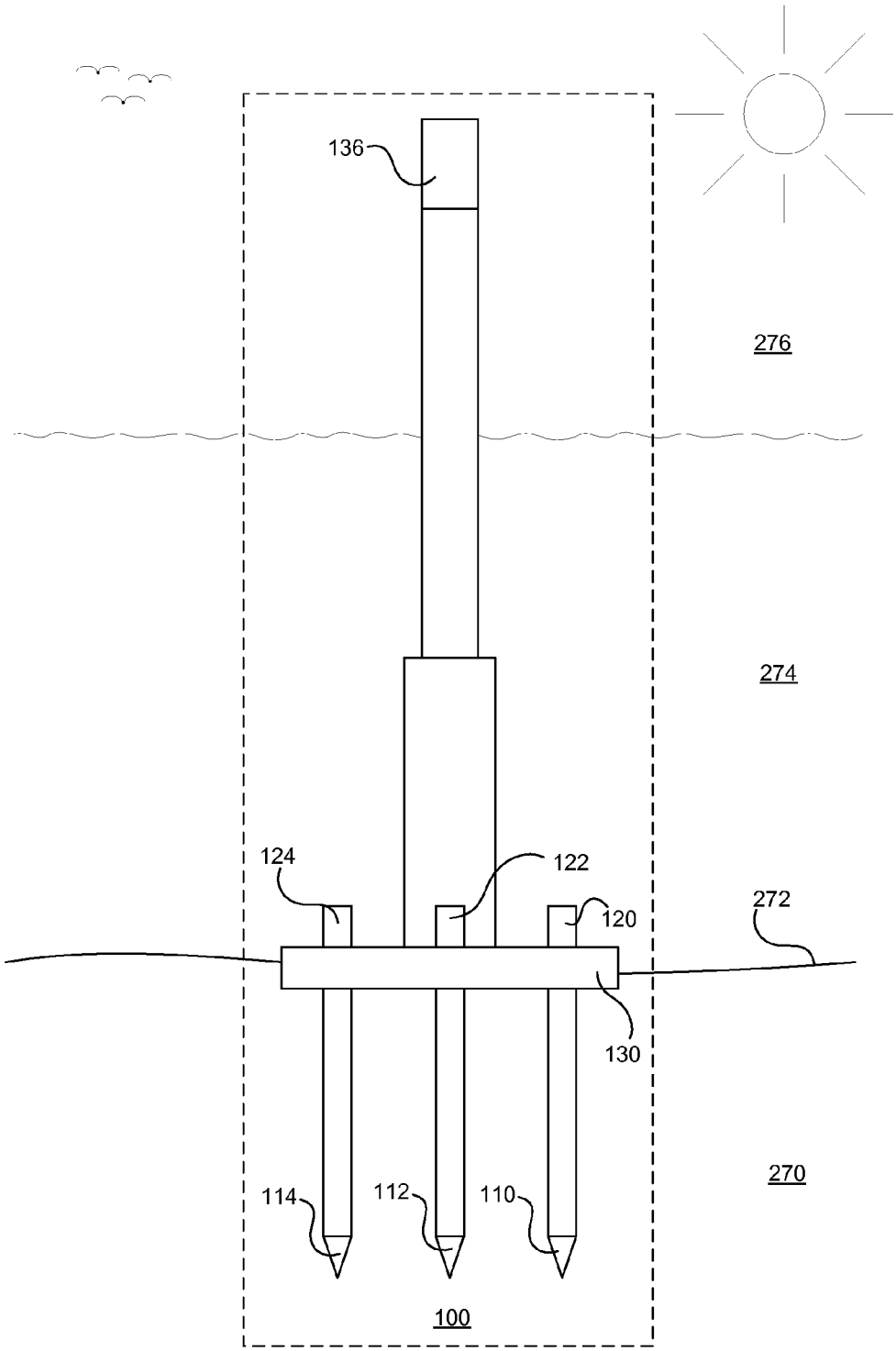
FIG. 2 is a block diagram of one embodiment of a Trident Probe Groundwater Exchange System.

FIG. 2 is a block diagram of one embodiment of a trident probe groundwater exchange system. TPGWES 100 of FIG. 2 is substantially similar to TPGWES 100 of FIG. 1, and thus, similar components are not described again. As shown in FIG. 2, TPGWES 100 is positioned for operational mode. Specifically, GW sensors and sampler (i.e., GW conductivity sensor 110, GW temperature sensor 112 and GW sampler 114) are located in ground 270 beneath surface water body 274. Thus, GW sensors and sampler can perform the tasks of sensing and sampling groundwater. SW sensors and sampler (i.e., SW conductivity sensor 120, SW temperature sensor 122 and SW sampler 124) are located in above ground 270 and near surface water floor 272, which is beneath surface water body 274. Thus, SW sensors and sampler can perform the task of sensing and sampling surface water. GPS 136 is located in above-surface-water-region 276, which is above surface water body 274. Thus, GPS 136 can obtain global positioning location data.

Figure 3:
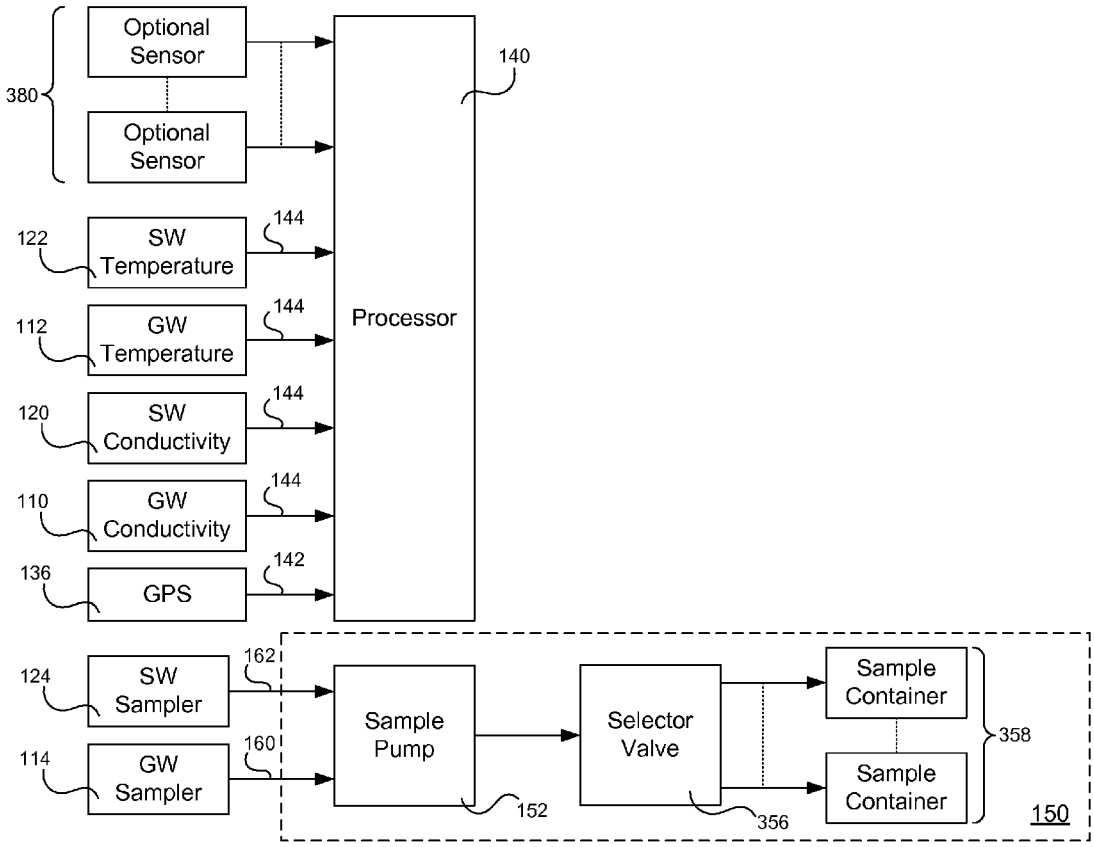
FIG. 3 is a block diagram of one embodiment of a Trident Probe Groundwater Exchange System.

FIG. 3 is a block diagram of one embodiment of a trident probe groundwater exchange system. TPGWES 300 of FIG. 3 is substantially similar to TPGWES 100 of FIG. 1, and thus, similar components are not described again. As shown in FIG. 3, TPGWES 300 further includes optional sensors 380, which are operatively coupled to processor 140 via sensor data links. Exemplary optional sensors 380 include GW pH sensor, SW pH sensor, GW oxygen sensor, SW oxygen sensor, GW ultraviolet fluorescence sensor and SW ultraviolet fluorescence sensor.

As shown in FIG. 3, sampling mechanism 150 comprises sample pump 152, selector valve 356 and plurality of sample containers 358. Sample pump 152 is operatively coupled to selector valve 356. SW or GW samples are pumped into one of the plurality of sample containers 358 depending on the position of selector valve 356. When the position of selector valve 356 changes, a different one of the plurality of sample containers 358 receives SW or GW samples.

Figure 4A:
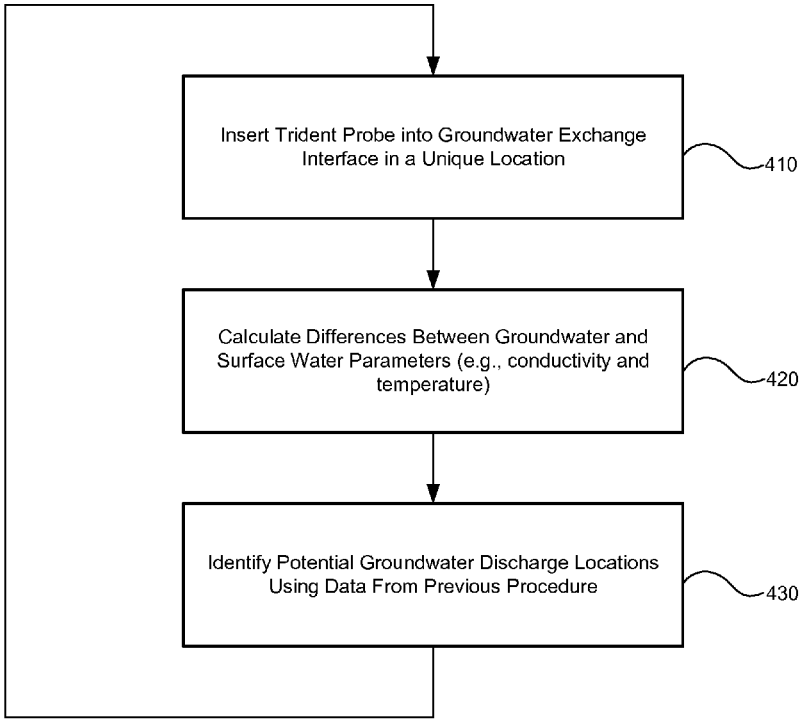
FIG. 4A is a flowchart of a method of operating one embodiment of a Trident Probe Groundwater Exchange System apparatus.
Figure 4B:
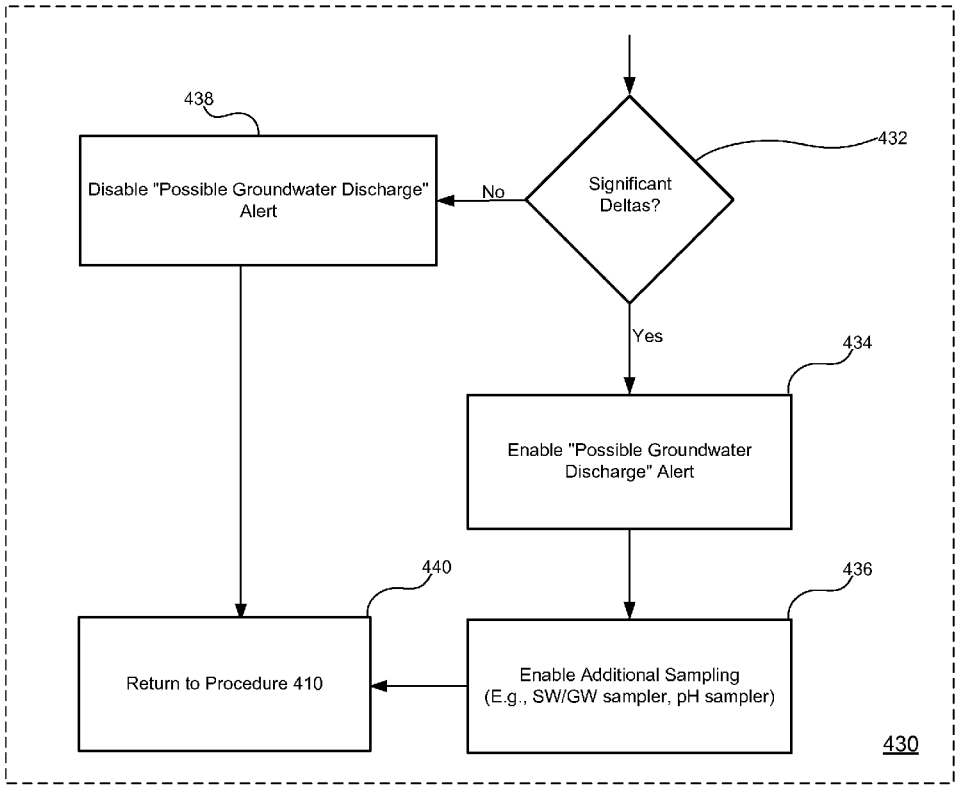
FIG. 4B is a flowchart of a method of operating one embodiment of a Trident Probe Groundwater Exchange System apparatus.

FIGS. 4A and 4B are flowcharts of methods of operating one embodiment of a trident probe groundwater exchange system. Certain details and features have been left out of the flowcharts of FIGS. 4A and 4B that are apparent to a person of ordinary skill in the art. For example, a procedure may consist of one or more sub-procedures or may involve specialized equipment or materials, as known in the art. While Procedures 410 through 430 shown in the flowcharts are sufficient to describe one embodiment of the present invention, other embodiments of the invention may utilize procedures different from those shown in the flowcharts.

Referring to FIG. 4A, at Procedure 410, the method inserts a trident probe groundwater exchange system into a groundwater exchange interface in a unique location. After Procedure 410, the method proceeds to Procedure 420. At Procedure 420, the method calculates differences between the groundwater and surface water parameters. In one embodiment of Procedure 420, the method calculates differences between GW/SW conductivity and temperature parameters. After Procedure 420, the method proceeds to Procedure 430. At Procedure 430, the method identifies potential groundwater discharge locations using data from the previous procedure. After Procedure 430, the method ends.

Referring to FIG. 4B, an embodiment of procedure 430 of FIG. 4A is depicted in greater detail. Procedure 430 comprises sub-procedures 432 to 440. At Procedure 432, the method determines whether the data from Procedure 420 of FIG. 4A has any significant deltas (i.e., changes). If so, the method proceeds to Procedure 434, else the method proceeds to Procedure 438. At Procedure 434, the method enables a "Possible Groundwater Discharge" alert. After Procedure 434, the method proceeds to Procedure 436. At Procedure 436, the method enables additional sampling. In one embodiment of Procedure 436, the method enables SW/GW sampling. In one embodiment of Procedure 436, the method enables pH sampling. After Procedure 436, the method proceeds to Procedure 440 where the method returns to Procedure 410 of FIG. 4A. At Procedure 438, the method disables a "Possible Groundwater Discharge" alert. After Procedure 438, the method proceeds to Procedure 440 where the method returns to Procedure 410 of FIG. 4A.

What is claimed is:

1. An apparatus, comprising:

a groundwater conductivity sensor, designed to determine a groundwater conductivity;

a surface water conductivity sensor, designed to determine a surface water conductivity;

a groundwater temperature sensor, designed to determine a groundwater temperature;

a surface water temperature sensor, designed to determine a surface water temperature;

a processor operatively coupled to a plurality of sensors and designed to receive information from said plurality of sensors;

a support member operatively coupled to said plurality of sensors; and an air hammer operatively coupled to said support member and designed to drive groundwater sensors into a ground.

2. The apparatus of claim 1, wherein said plurality of sensors comprises groundwater conductivity, surface water conductivity, groundwater temperature, surface water temperature sensors.

3. The apparatus of claim 1, wherein said apparatus further comprises a surface water sampler and a ground water sampler, designed to obtain surface water and groundwater samples, respectively.

4. The apparatus of claim 1, wherein said apparatus further comprises a sampler pump and a manifold having a plurality of sample containers.

5. The apparatus of claim 1, wherein said apparatus further comprises a groundwater pH sensor and a surface water pH sensor.

6. The apparatus of claim 1, wherein said apparatus further comprises a groundwater oxygen sensor and a surface water oxygen sensor.

7. The apparatus of claim 1, wherein said apparatus further comprises a groundwater ultraviolet fluorescence sensor and a surface water ultraviolet fluorescence sensor.

8. The apparatus of claim 1, wherein said apparatus further comprises a global positioning system (GPS) device operatively coupled to said processor and designed to transmit GPS data to said processor.

9. The apparatus of claim 1, wherein said apparatus further comprises a push rod, designed to help manually drive groundwater sensors into a ground.

10. An apparatus, comprising:

a support member, designed to support a plurality of sensors;

a groundwater conductivity sensor, designed to determine a groundwater conductivity, operatively coupled to said support member;

a surface water conductivity sensor, designed to determine a surface water conductivity, operatively coupled to said support member;

a groundwater temperature sensor, designed to determine a groundwater temperature, operatively coupled to said support member;

a surface water temperature sensor, designed to determine a surface water temperature, operatively coupled to said support member;

a processor operatively coupled to said plurality of sensors and designed to receive information from said plurality of sensors.

11. The apparatus of claim 10, wherein said apparatus further comprises a surface water sampler and a groundwater sampler, designed to obtain surface water and groundwater samples, respectively.

12. The apparatus of claim 10, wherein said apparatus further comprises a sampler pump and a manifold having a plurality of sample containers.

13. The apparatus of claim 10, wherein said apparatus further comprises a groundwater pH sensor and a surface water pH sensor.

14. The apparatus of claim 10, wherein said apparatus further comprises a groundwater oxygen sensor and a surface water oxygen sensor.

15. The apparatus of claim 10, wherein said apparatus further comprises a groundwater ultraviolet fluorescence sensor and a surface water ultraviolet fluorescence sensor.

16. The apparatus of claim 10, wherein said apparatus further comprises a GPS device operatively coupled to said processor and designed to transmit GPS data to said processor.

17. An apparatus, comprising:

a support member, designed to support a plurality of sensors;

a groundwater conductivity sensor, designed to determine a groundwater conductivity, operatively coupled to said support member;

a surface water conductivity sensor, designed to determine a surface water conductivity, operatively coupled to said support member;

a groundwater temperature sensor, designed to determine a groundwater temperature, operatively coupled to said support member;

a surface water temperature sensor, designed to determine a surface water temperature, operatively coupled to said support member;

an air hammer operatively coupled to said support member, designed to drive groundwater sensors into a ground;

a push rod operatively coupled to said air hammer, designed to help manually drive groundwater sensors into said ground;

a processor operatively coupled to said plurality of sensors and designed to receive information from said plurality of sensors.

* * * * *